US005839426A

United States Patent [19]

Aretxaga

[11] Patent Number: 5,839,426

[45] Date of Patent: Nov. 24, 1998

[54] GAS DISTRIBUTION BOX TO STOVE BURNERS

[75] Inventor: Iñaki Ayastuy Aretxaga, Bergara, Spain

[73] Assignee: Fagor, S. Coop, Mondragon, Spain

[21] Appl. No.: 979,817

[22] Filed: Nov. 26, 1997

[51] Int. Cl.[6] ..... F24C 3/00

[52] U.S. Cl. ..... 126/39 N; 126/39 R; 137/883; 251/180

[58] Field of Search ..... 126/39 R, 39 N, 126/39 E, 39 G; 137/338; 251/304, 206, 180

[56] References Cited

U.S. PATENT DOCUMENTS

| | | | |
|---|---|---|---|
| 456,546 | 7/1891 | Blankerts | 137/883 |
| 1,300,120 | 4/1919 | Charles | 251/180 |
| 1,775,980 | 9/1930 | Walbridge | 126/39 N |
| 4,241,761 | 12/1980 | Miller | 137/883 |
| 4,685,652 | 8/1987 | Shopsky | 137/883 |

*Primary Examiner*—James C. Yeung
*Attorney, Agent, or Firm*—Pro-Techtor International Services

[57] ABSTRACT

A gas distribution box for the top burners of a stove includes a sealed gas distribution conduit in the form of a channel formed between a base plate and a cover plate. Inside the palates are elements which control the flow of gas to each burner. Only the operating shafts and a common gas inlet and individual outlets connectors protrude from the plates. The regulators for gas flow to each burner are a valve with an operating shaft and a bypass screw. The valves include two superposed flat discs, one fixed and the other rotary, fitted between the base and the cover. A pusher cooperates with the operating shaft.

2 Claims, 1 Drawing Sheet

GAS DISTRIBUTION BOX TO STOVE BURNERS

BACKGROUND OF THE INVENTION

1. Technical field

The present invention relates to the gas fuel distributor and the control elements to distribute gas to the top burners of a domestic stove from a common supply by means of various individual control knobs and outlets.

2. Prior art

GB-2102557 describes a gas distribution conduit to various stove burners with a channel shaped cross-section. The conduit is made with two flat plates superposed and sealed together, with the taps for each burner screwed on externally. The taps are independent articles operating separately with their own gas inlet and outlet and individual clamps for fixing to the distribution conduit.

SUMMARY OF THE INVENTION

The present invention is a gas distribution box for the top burners of a domestic stove that is provided with a common gas inlet and several individual outlets. The individual elements for control of the gas flow are valves formed as part of the distribution box. Each of the gas valve chambers is formed by the walls of the box. The box is constructed from two pressed plates, a base plate and a cover plate.

Unlike the known solution from the cited prior art document, the gas distribution box according to the present invention has the advantage of reduced cost because the valves are not independent elements. The base and the cover of the box form a common body for the plurality of valves. The box walls themselves form the plurality of sealed gas outlet chambers, one for each burner. The present invention also has the advantage of providing a single construction for the set of valves and distribution conduit without the need for a subsequent coupling mechanism between them. An added advantage of the present invention is that the distribution box is of universal use, being valid for any domestic cooking apparatus with top burners.

The gas distribution box is constructed as a compact and indivisible element by means of the two pressed plates which are superposed and joined. The plates form a sealed gas conduit and, at the same time, the housing enclosure for the control valves. The free ends of the rotary shafts project from the distribution box to operate the valves and the gas connectors, the common inlet and the individual outlets.

To reduce the thickness of the distribution box and to achieve, by using seal rings, a sealed fit for the control valves between the base and cover of the distribution box, the type of valve preferably used is an obturator disc type valve. A rotary disc slips on a fixed seat disc secured to the box cover so that the relative rotation of the discs permits the flow of gas from the intake chamber common to all the valves, through the passage slots in the obturator and seat discs, to the individual outlet chambers and to the burners.

The operating shaft drives the rotatable obturator disc in cooperation with a cylindrical pusher coaxially coupled to the shaft, and also incorporated into the box. The minimum flow through each valve is regulated using a bypass screw which is connected externally to the distribution box.

DETAILED DESCRIPTION OF THE PREFERRED EMBODIMENT

Figure 1:
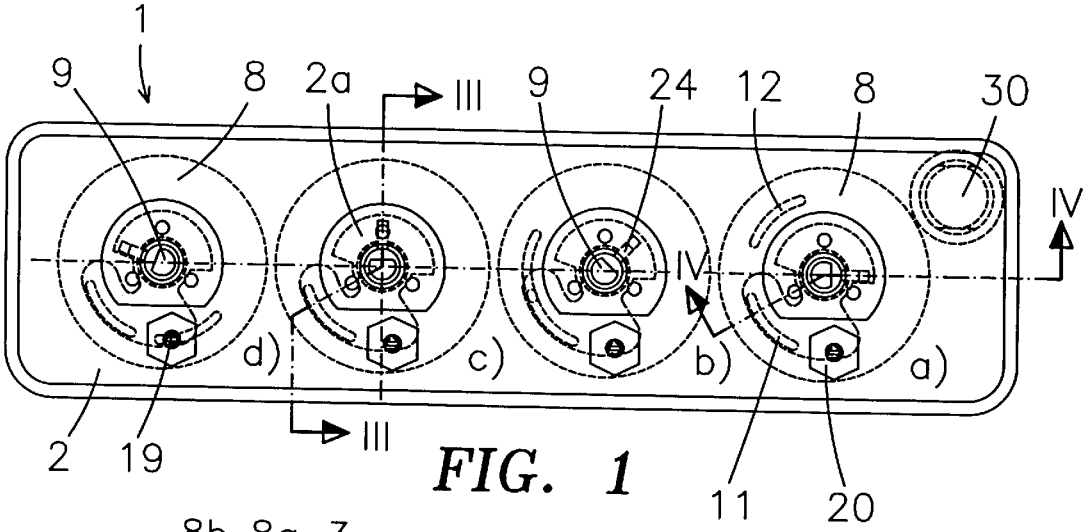
FIG. 1 is a front view of the gas distribution box according to the invention, with a plurality of rotary valves, which are shown in different angular positions.

With reference to FIGS. 1–5, the box 1 for distribution of gas to the burners of a domestic stove, according to the present invention, is constructed with a cover 2 and a base 3. The cover 2 and the base 3 are pressed plates, both welded along their edges to form between them a gas distribution conduit including a common gas intake chamber 5 and individual exit chambers 6 for each burner. The box 1 also includes individual housing bodies wherein disc valves 8 are fitted. Each valve 8 is provided with an operating shaft 9.

The cover 2 has a circular recess 2*a* for each valve 8. The recess 2*a* is pressed into the interior of the box 1 to form the tubular guide support 2*b* for each shaft 9. The recess 2*a* also provides the support wall on which the seat disc 8 of the valve is secured and sealed.

Figure 3:
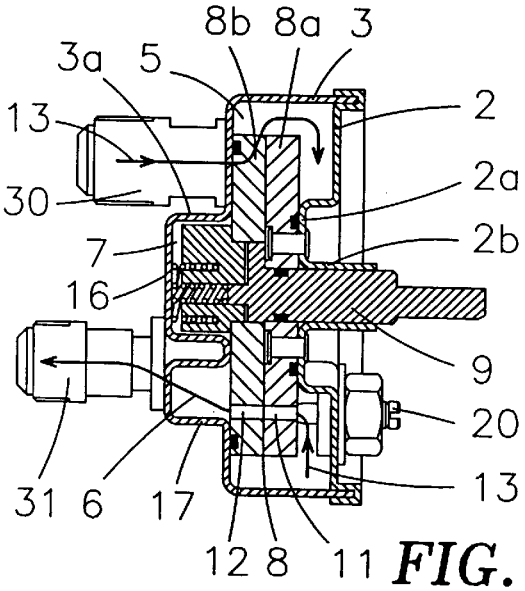
FIG. 3 is a transverse cross-section of the distribution box along line III—III in FIG. 1.
Figure 2:
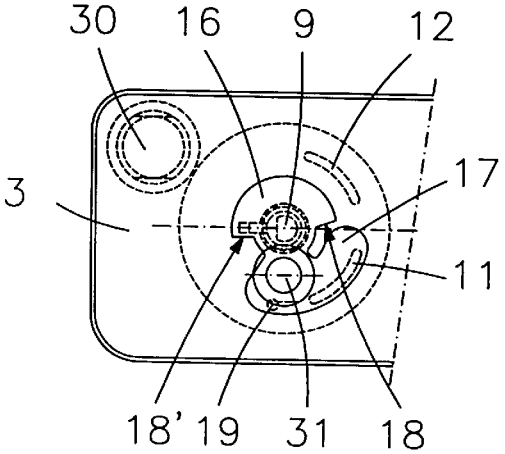
FIG. 2 is a partial view of the back of the distribution box in FIG. 1.

The base 3 of the box has protruding housings 3*a* for each valve which are divided into two parts, as shown in FIGS. 2 and 3. One part is a sector 16, which is in the form of a 160° circular sector, and forms the housing 7 for a pusher 10 and stops 18 and 18'. The stops 18, 18' limit the rotation in both directions of control shaft 9. The other part of the housing, section 17, has an arch shape and encloses the chamber 6 to form an individual outlet for the gas. Each chamber 6 is situated over an arched slot 11 of the seat disc 8 where the gas flow arrives from the inlet connector 30 in the direction of arrow 13 in FIG. 3. The gas then leaves through outlet connectors 31.

An obturator disc 8*b* of the valve closes the gas output chamber 6 by means of a seal ring 14 against the base 3. The seat disc 8*a* closes the intake chamber 5 using a seal ring 15 against the recessed section 2*a* of the cover. The enclosure formed between cover plate 2 and base plate 3 for housing the valves 8 also forms the gas distribution conduit of the box 1.

As shown in FIG. 1, the shaft 9 of the gas regulation knob turns through a maximum 160° angle from an initial gas flow closed setting. Each shaft 9 has four gas flow positions—off, medium, maximum and minimum—shown in FIG. 1 by settings a) b), c) and d) of the rotary disc 8*b*. In the two intermediate positions b) and c) of the rotating disc 8*b*, a passage slot 12 is partially or totally superposed on the passage slot 11 of the seat disc 8*a*. In the minimum setting d) in FIG. 1, the moving slot 12 is superposed on the bypass orifice 19 which is coaxial with the minimum flow adjustment screw 20.

Figure 5:
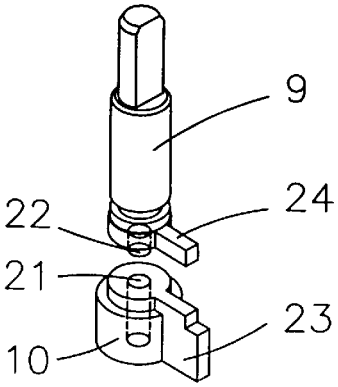
FIG. 5 is a view of the operating shaft for a valve and its locking pusher.

As shown in FIG. 5, the operating shaft 9 has an axial coupling protrusion 22 on its inner end and a radial locking and drive tail 24. The cylindrical pusher 10 has a coupling orifice 21, which receives a protrusion 22 on shaft 9. The pusher 10 has a radial fin 23 with a stepped surface corresponding to the radial tail 24 which cooperate to drive the disc 8*b* in its rotation. A central spring 25 housed in the pusher orifice 21 returns the shaft 9 to its rest position when the user stops pushing against the knob. A coupling spring 26 holds the pusher 10 pressed against the obturator disc 8*b*.

Figure 4:
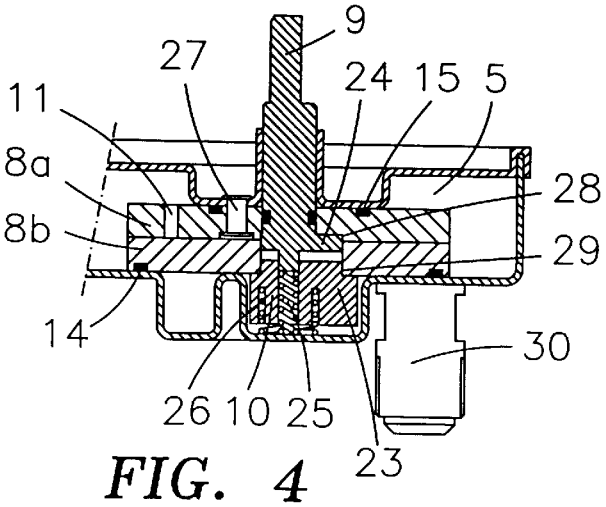
FIG. 4 is a partial lengthwise cross-section of the distribution box along line IV—IV in FIG. 1.

The seat disc 8*a* and the obturator disc 8*b* are made in this preferred embodiment of ceramic material to increase resistance to wear of the surfaces in contact. The seat disc 8*a* is fixed to the pressed section 2*a* of the cover by rivets 27. The seat disc 8*a* has a notch 28, as shown in FIG. 4, where part of the tail 24 on the operating shaft fits. The obturator disc 8*b* has a through notch 29 into which both the remaining part of the tail 24 on the shaft and the fin 23 on the pusher fit. As a consequence of the location of the adjustment screw 20 on the front in the cover for easy user access, in this preferred embodiment of the gas distribution box, the rotary disc 8*b* is placed behind the fixed seat disc 8*a*, i.e. away from the end of the shaft 9, which is why the rotary disc 8*b* is provided with the pusher 10.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A gas distribution box for the top burners of a domestic stove comprising:

a sealed gas flow conduit positioned in a housing, said conduit includes a common inlet gas chamber and a plurality of individual outlet gas chambers, each said outlet gas chamber directs gas flow to a respective burner, a plurality of control means to regulate the gas flow to respective burners, each said control means comprises a flow regulating valve and a valve operating shaft, a free end of said valve operating shaft extends outside said box walls; wherein said housing comprises box walls formed with a base plate and a cover plate, said base plate houses said valves and forms said plurality of individual outlet gas chambers, said cover plate in cooperation with said base plate forms said common inlet chamber; and wherein said base plate comprises end stops to limit rotation of said valve shafts.

2. The gas distribution box of claim 1 wherein:

each said flow regulating valve comprises;

a valve seat disc fixed to a first one of said box walls, a rotary disc abutting said valve seat disc, said rotary disc is rotatably connected to a second one of said box walls; and said rotary disc is driven by said valve operating shaft.

* * * * *